US012281871B2

(12) United States Patent
Collins

(10) Patent No.: US 12,281,871 B2
(45) Date of Patent: Apr. 22, 2025

(54) MAGNETIC TRIGGER RELEASE SYSTEM

(71) Applicant: Darren A. Collins, Galena, KS (US)

(72) Inventor: Darren A. Collins, Galena, KS (US)

( * ) Notice: Subject to any disclaimer, the term of this patent is extended or adjusted under 35 U.S.C. 154(b) by 205 days.

(21) Appl. No.: 18/325,020

(22) Filed: May 29, 2023

(65) Prior Publication Data

US 2024/0401900 A1 Dec. 5, 2024

(51) Int. Cl.
*F41B 5/18* (2006.01)
*F41A 19/10* (2006.01)
*F41B 5/14* (2006.01)

(52) U.S. Cl.
CPC ..... *F41B 5/1469* (2013.01); *F41A 19/10* (2013.01)

(58) Field of Classification Search
CPC ..... F41A 19/00; F41A 19/10; F41B 5/1469
See application file for complete search history.

(56) References Cited

U.S. PATENT DOCUMENTS 6,802,305 B1 * 10/2004 Hatcher ..... F41A 19/10 124/31
7,231,911 B2 * 6/2007 Hatcher ..... F41A 19/10 124/31
9,915,491 B2 * 3/2018 Perry ..... F41A 19/10
11,215,415 B2 * 1/2022 Delgado Acarreta ... F41A 19/10
12,085,356 B2 * 9/2024 Jones ..... F41B 5/1469
2006/0042612 A1 3/2006 Stanislawski

* cited by examiner

*Primary Examiner* — John A Ricci
(74) *Attorney, Agent, or Firm* — Martin & Associates, LLC; Derek P. Martin

(57) ABSTRACT

A trigger release system includes a trigger release that is magnetically-actuated. The trigger on the trigger release is coupled to a mechanical release such that a predetermined amount of force on the trigger causes the mechanical release to trip. A first embodiment uses magnetic repulsion between a magnet on a wearable article worn by the shooter and a magnet on the trigger. A second embodiment uses magnetic attraction between a magnet on a wearable article worn by the shooter and a magnet on the trigger. A third embodiment uses magnetic attraction between a magnet on a wearable article and a trigger made of magnetic metal. All three embodiments provide a magnetically-actuated trigger release. Providing a trigger release system with a magnetically-actuated trigger release provides a surprise actuation of the trigger release, thereby improving accuracy of the shooter.

21 Claims, 12 Drawing Sheets

MAGNETIC TRIGGER RELEASE SYSTEM

BACKGROUND

1. Technical Field

This disclosure generally relates to shooting, and specifically releases to a magnetic trigger release system for shooting.

2. Background Art

Those who enjoy shooting sports such as archery and firearm shooting must learn discipline to have accurate shot placement. Various techniques and devices have been used over time to improve a shooter's accuracy. For example, in the field of archery, various different types of releases have been developed. Many of these archery releases are trigger-activated, and are therefore called trigger releases. Issues such as target panic, trigger punching and shot anticipation can negatively affect a shooter's accuracy. Trigger punching means a shooter mashes or yanks the trigger on a trigger release, which causes the archer's shots not to be accurate or consistent.

BRIEF SUMMARY

A trigger release system includes a trigger release that is magnetically-actuated. The trigger on the trigger release is coupled to a mechanical release such that a predetermined amount of force on the trigger causes the mechanical release to trip. A first embodiment uses magnetic repulsion between a magnet on a wearable article worn by the shooter and a magnet on the trigger. A second embodiment uses magnetic attraction between a magnet on a wearable article worn by the shooter and a magnet on the trigger. A third embodiment uses magnetic attraction between a magnet on a wearable article and a trigger made of magnetic metal. All three embodiments provide a magnetically-actuated trigger release.

In the first and second embodiments, the shooter activates the trigger release by closing the gap between the two magnets by moving the magnet on the shooter's body to be closer to the magnet on the trigger portion. In the first embodiment, the magnet on the wearable article on the shooter's body is oriented to provide a repulsive force to a magnet on the trigger such that the shooter moving the magnet worn on the shooter's body closer to the magnet on the trigger causes the repulsive force between the magnets to increase until the repulsive force provides the predetermined amounted of force on the trigger, thereby causing the trigger to actuate the mechanical release. In a second embodiment, the magnet on the wearable article on the shooter's body is oriented to provide an attractive force to a magnet on the trigger such that the shooter moving the magnet worn on the shooter's body closer to the magnet on the trigger causes the attractive force between the magnets to increase until the attractive force provides the predetermined amount of force on the trigger, thereby causing the trigger to actuate the mechanical release. In a third embodiment, the trigger of the trigger release is made of a magnetic metal such that the shooter moving a magnet worn on the wearable article on the shooter's body closer to the trigger causes the attractive force between the magnet and the trigger to increase until the attractive force provides the predetermined amount of force on the trigger, thereby causing the trigger to actuate the mechanical release. Providing a trigger release system with a magnetically-actuated trigger release provides a surprise actuation of the trigger release, thereby improving accuracy of the shooter.

The foregoing and other features and advantages will be apparent from the following more particular description, as illustrated in the accompanying drawings.

BRIEF DESCRIPTION OF THE SEVERAL VIEWS OF THE DRAWING(S)

The disclosure will be described in conjunction with the appended drawings, where like designations denote like elements, and:

DETAILED DESCRIPTION

A trigger release system includes a trigger release that is magnetically-actuated. The trigger on the trigger release is coupled to a mechanical release such that a predetermined amount of force on the trigger causes the mechanical release to trip. A first embodiment uses magnetic repulsion between a magnet on a wearable article worn by the shooter and a magnet on the trigger. A second embodiment uses magnetic attraction between a magnet on a wearable article worn by the shooter and a magnet on the trigger. A third embodiment uses magnetic attraction between a magnet on a wearable article and a trigger made of magnetic metal. All three embodiments provide a magnetically-actuated trigger release.

In the first and second embodiments, the shooter activates the trigger release by closing the gap between the two magnets by moving the magnet on the shooter's body to be closer to the magnet on the trigger portion. In the first embodiment, the magnet on the wearable article on the shooter's body is oriented to provide a repulsive force to a magnet on the trigger such that the shooter moving the magnet worn on the shooter's body closer to the magnet on the trigger causes the repulsive force between the magnets to increase until the repulsive force provides the predetermined amounted of force on the trigger, thereby causing the trigger to actuate the mechanical release. In a second embodiment, the magnet on the wearable article on the shooter's body is oriented to provide an attractive force to a magnet on the trigger such that the shooter moving the magnet worn on the shooter's body closer to the magnet on the trigger causes the attractive force between the magnets to increase until the attractive force provides the predetermined amount of force on the trigger, thereby causing the trigger to actuate the mechanical release. In a third embodiment, the trigger of the trigger release is made of a magnetic metal such that the shooter moving a magnet worn on the wearable article on the shooter's body closer to the trigger causes the attractive force between the magnet and the trigger to increase until the attractive force provides the predetermined amount of force on the trigger, thereby causing the trigger to actuate the mechanical release. Providing a trigger release system with a magnetically-actuated trigger release provides a surprise actuation of the trigger release, thereby improving accuracy of the shooter.

Figure 1:
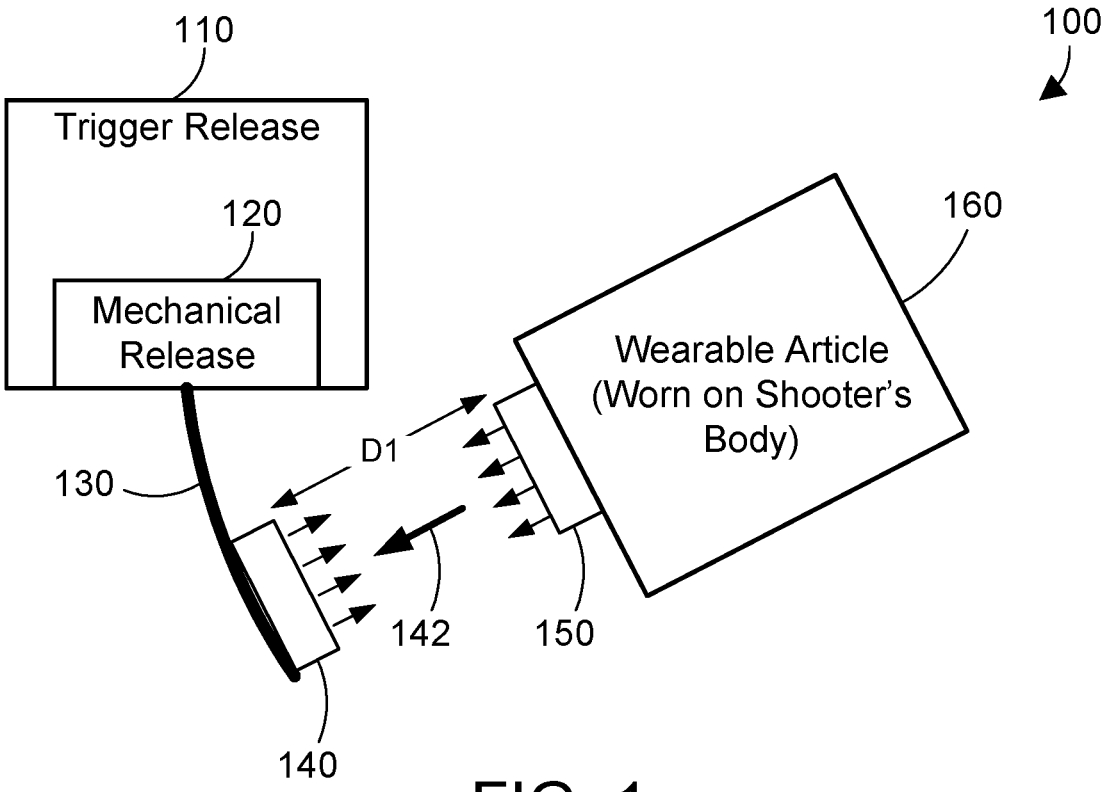
FIG. 1 is a block diagram of a magnetic trigger release system according to a first embodiment showing a second magnet in the wearable article at a first distance from the first magnet on the trigger.

Referring to FIG. 1, a trigger release system 100 in accordance with the first embodiment operates based on magnetic repulsion. The trigger release system 100 includes a trigger release 110 that has a trigger 130 that actuates a mechanical release 120, thereby causing actuation of the trigger release. The trigger 130 has a first magnet 140 attached to the trigger. The first magnet 140 can be manufactured to be an integral part of trigger 130, or can be an aftermarket add-on that is attached to trigger 130 in any suitable way. The trigger release system 100 includes not only the trigger release 110, but also includes a wearable article 160 that is worn on a shooter's body. The wearable article 160 includes a second magnet 150 that is oriented such that the second magnet 150 provides a repulsive force when brought into proximity to the first magnet 140. It is well-known that opposite poles of two magnets attract while the same poles of the two magnets repel. Thus, if the first magnet is 140 is oriented with its south pole against the trigger and its north pole facing the direction of the four arrows in FIG. 1 emanating from the first magnet 140, this means the second magnet 150 is oriented with its south pole closer to the shooter's body and its north pole facing the direction of the four arrows in FIG. 1 emanating from the second magnet 150. Similarly, if the first magnet is 140 is oriented with its north pole against the trigger and its south pole facing the direction of the four arrows in FIG. 1 emanating from the first magnet 140, this means the second magnet 150 is oriented with its north pole closer to the shooter's body and its south pole facing the direction of the four arrows in FIG. 1 emanating from the second magnet 150. In both cases, the first magnet 140 and second magnet 150 are oriented to repel each other.

The trigger 130 on trigger release 110 is configured to actuate the mechanical release 120 once a predetermined force is applied to the face of the trigger 130. In FIG. 1, the force applied to the trigger 130 is in the direction shown by arrow 142. Once the predetermined force is applied to trigger 130 in the direction of the arrow 142, the trigger actuates the mechanical release 120, which causes the trigger release to be actuated. In one example, an archery release may actuate with 4 ounces (1 Newton) of force on the trigger. In another example, a firearm release may actuate with 8 pounds (36 Newtons) of force on the trigger. The amount of force needed for a trigger to actuate the mechanical release can vary greatly within the scope of the disclosure and claims herein depending on the specific application and the shooter's personal preference.

Figure 2:
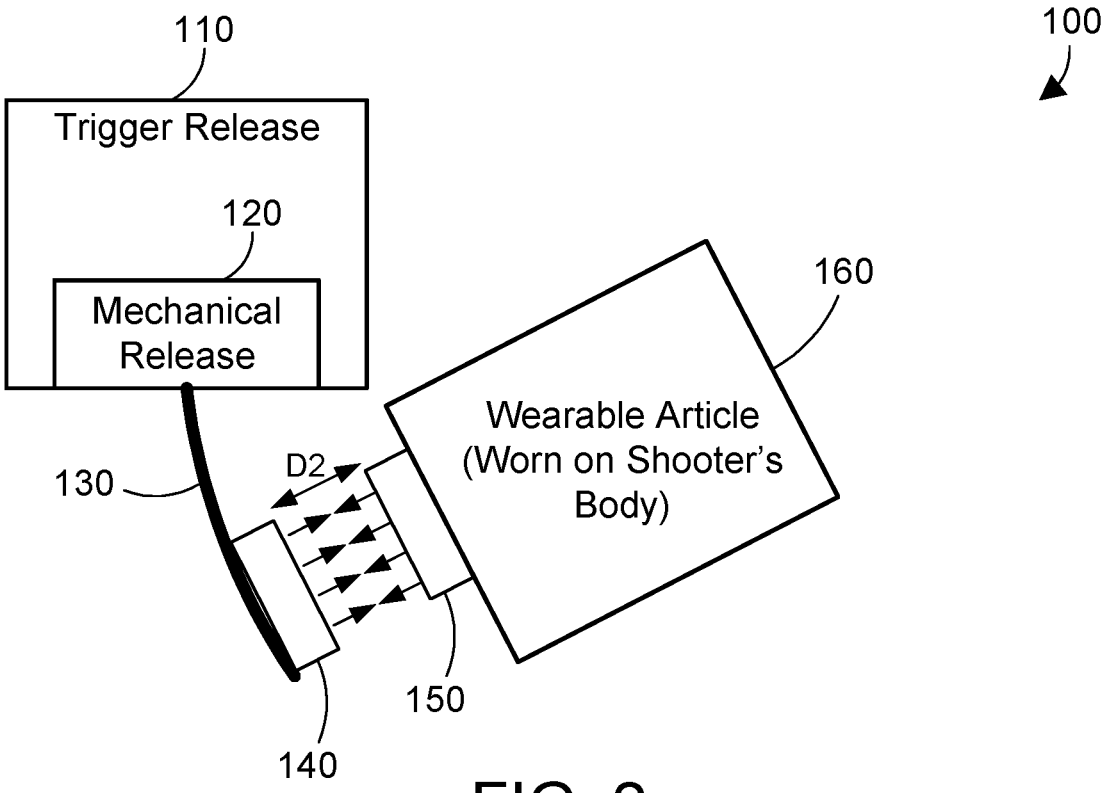
FIG. 2 is a block diagram of the magnetic trigger release system in FIG. 1 showing the second magnet in the wearable article at a second distance from the first magnet on the trigger which increases the force on the trigger due to magnetic repulsion in accordance with the first embodiment.

In FIG. 1 the second magnet 150 is at a first distance D1 from first magnet 140. FIG. 2 shows the same components in FIG. 1 with the second magnet 150 at a closer distance D2 from the first magnet 140. We assume for this simple example that distance D1 in FIG. 1 between the second magnet 150 and the first magnet 140 causes little to no repulsive force between the magnets, while distance D2 in FIG. 2 causes significant repulsive force between the magnets, which creates force on trigger 130. As the distance between magnets 140 and 150 decreases by the shooter moving the second magnet 150 on the wearable article 160 closer to the first magnet 140, the force on trigger 130 is increased until a point is reached where the predetermined force on the trigger is applied by magnetic repulsion, causing the trigger 130 to actuate the mechanical release 120 without the two magnets 140 and 150 ever touching. The result is a surprise break for trigger release 110, which greatly increases accuracy of the shooter.

The magnets 140 and 150 in the first embodiment can have any suitable size, strength and configuration and can be of any suitable type to perform their intended function. The only constraint on the magnets 140 and 150 is they must be strong enough to cause a repulsive force greater than the predetermined force that causes the trigger 130 to actuate the mechanical release 120. All magnets that provide a repulsive force that exceeds the predetermined force that causes the trigger 130 to actuate the mechanical release 120 are within the scope of the disclosure and claims herein.

The wearable article 160 can be any suitable way for a shooter to attach a magnet to a body. Examples of suitable wearable articles 160 include, without limitation, a glove, a ring that can be worn on a finger or thumb, a strap that can be attached to the shooter's body, and a magnet that can be attached to the shooter's body using tape. Some wearable articles may be worn on the shooter's fingers or thumb. However, other wearable articles could be worn on other parts of a shooter's body. All wearable articles that allow a shooter to move the second magnet 150 in proximity to the first magnet 140 are within the scope of the disclosure and claims herein.

While the trigger 130 shown in FIGS. 1 and 2 is show having an arcuate shape like many firearm triggers, the trigger 130 can have any suitable shape or configuration. Various different shapes and configurations of triggers are shown in FIGS. 4, 5 and 8-13, which are discussed in detail below. The disclosure and claims herein expressly extend to any suitable shape or configuration for a trigger in a trigger release.

Figure 3:
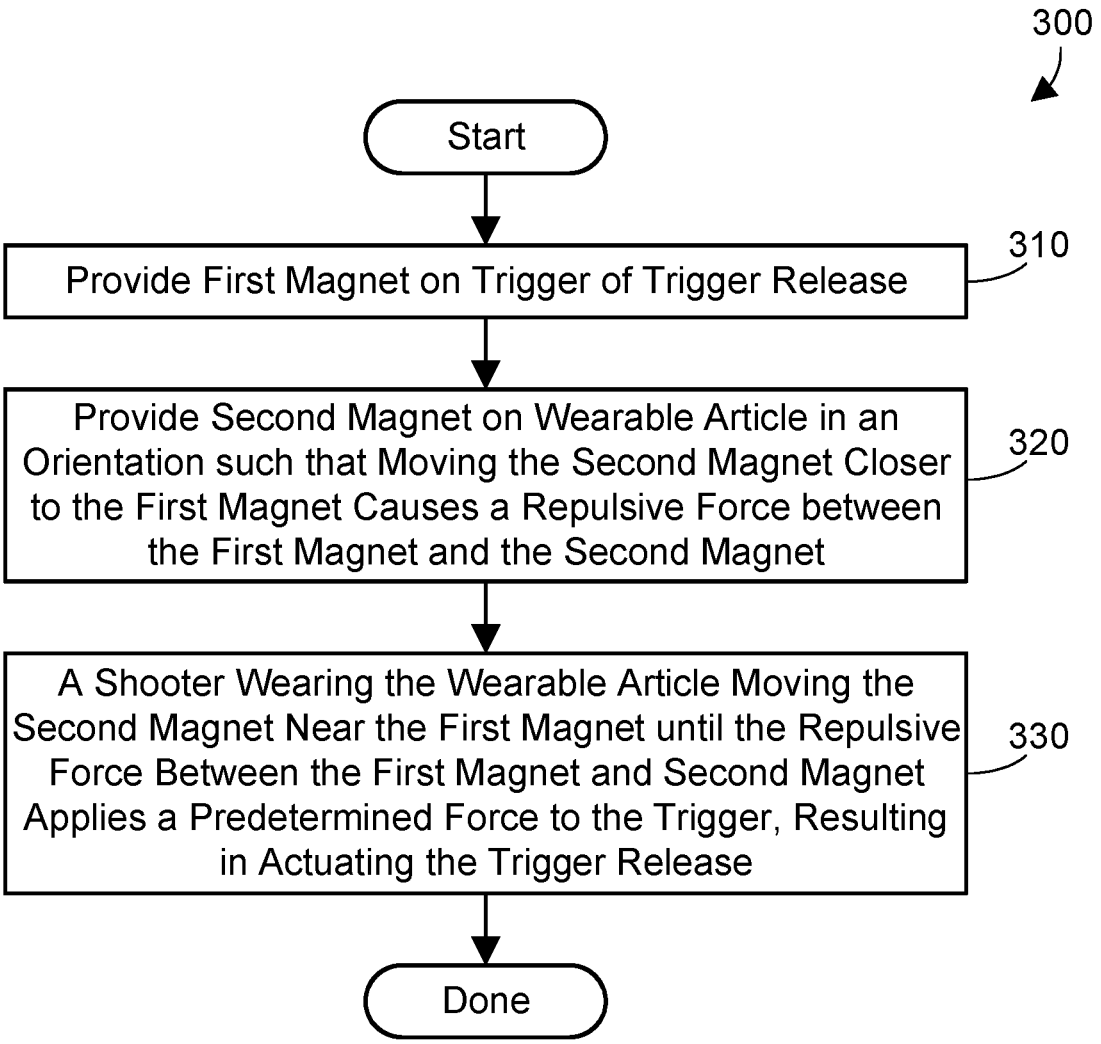
FIG. 3 is a flow diagram of a method in accordance with the first embodiment.

Referring to FIG. 3, a method 300 in accordance with the first embodiment provides a first magnet on a trigger of a trigger release (step 310). A second magnet is provided on a wearable article in an orientation such that moving the second magnet closer to the first magnet causes a repulsive force between the first magnet and the second magnet (step 320). A shooter wearing the wearable article then moves the second magnet near the first magnet until the repulsive force between the first magnet and second magnet applies a predetermined force to the trigger, resulting in actuating the trigger release (step 330). Method 300 is then done.

Figure 4:
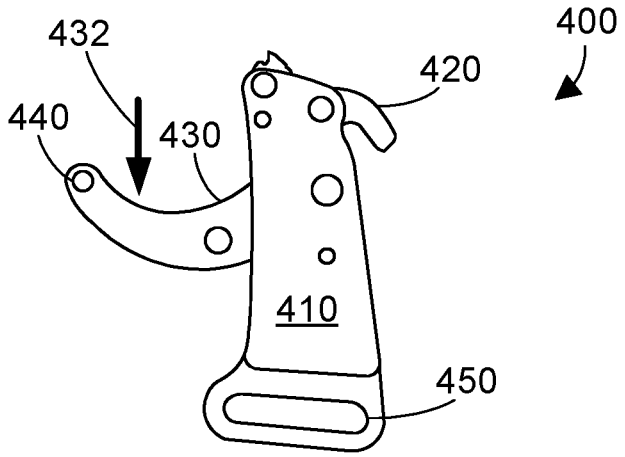
FIG. 4 is a side view of a first suitable trigger release for use in archery.

FIG. 4 shows a first archery release 400 that is very similar to a known archery release. Archery release 400 includes a body portion 410, a slot 450 for attaching a strap, a hook 420 for holding a bow string, and a trigger 430. The trigger 430 is actuated by applying a predetermined force in the direction of arrow 432 in FIG. 4. The release 400 is typically attached to a strap that goes around a shooter's wrist, putting the release 400 in a position where one of the shooter's fingers can press trigger 430 in the direction shown by the arrow 432. To use release 400, a shooter hooks a bow string on hook 420, draws the bow string back, then presses on trigger 430 with his or her index finger to apply the predetermined pressure to trigger 430, which actuates an internal mechanical release, which causes the hook 420 to pivot in a counterclockwise direction, causing the hook 420 to release the bow string, thereby causing the bow to shoot the arrow.

Figure 5:
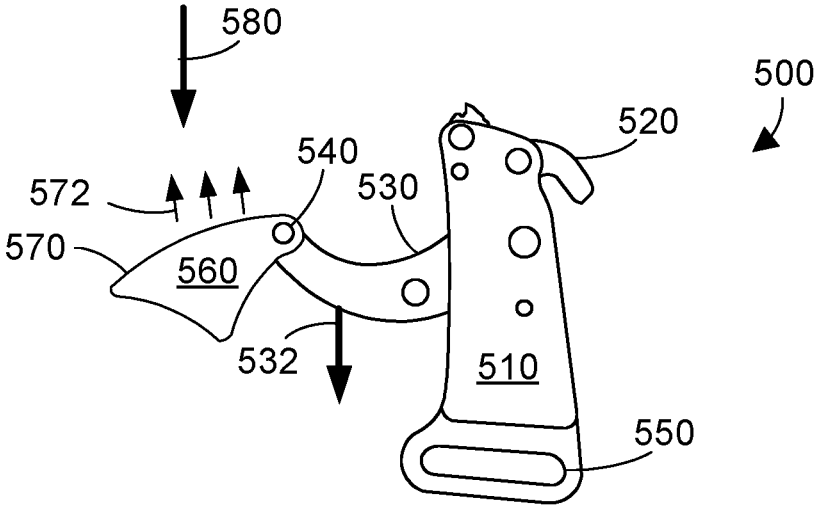
FIG. 5 is a side view of a trigger release similar to the release in FIG. 4 and configured to include a first magnet that can be actuated by magnetic repulsion from a second magnet on a wearable article on the shooter's body.

Known releases like release 400 include a hole 440 that allows attaching an extension piece onto the trigger 430 that provides the shooter with a bigger trigger that is more easily pressed. The release 400 shown in FIG. 4 can thus be converted to a magnetically-actuated release by attaching an extension piece 560 onto the trigger 530 with a suitable fastener 540 that passes through hole 440 shown in FIG. 4, as shown in FIG. 5. The body 510, hook 520, trigger 530 and slot 550 are preferably the same as corresponding items 410, 420, 430 and 450 in FIG. 4, but these could also be different within the scope of the disclosure and claims herein. The extension piece 560 preferably includes a magnetic portion 570 that provides a magnetic force in the direction indicated by arrows 572 in FIG. 5. When a shooter brings a magnet on a wearable article in proximity to the extension piece 560 in the direction shown by arrow 580 in FIG. 5, the magnet on the wearable article will repel the magnetic portion 570 on the extension piece 560, thereby creating force on the trigger 530 in the direction shown by arrow 532 in FIG. 5. Once the repulsive force between the magnets reaches the predetermined force needed to actuate the trigger 530, the trigger actuates the internal mechanical release, causing the hook 520 to release the bow string.

In one embodiment, a release similar to release 400 in FIG. 4 can be converted into a magnetically-actuated release by simply attaching an extension piece 560 that includes a magnet, as shown in FIG. 5. However, in an alternative embodiment, the release 400 in FIG. 4 could have a trigger 430 that is manufactured to include a magnet. Thus, both configurations in FIGS. 4 and 5 represent a trigger release that includes a first magnet that can be magnetically actuated by a second magnet on a wearable article without the first magnet and second magnet touching each other.

Figure 6:
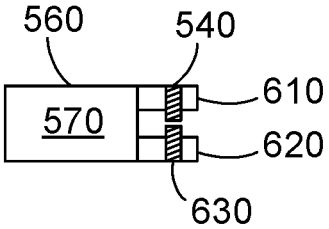
FIG. 6 is a top view of a first implementation for the extension piece shown in FIG. 5.

One suitable implementation for extension piece 560 is shown in FIG. 6. The magnetic face is shown at 570 in FIG. 7, which means the arrows 572 in FIG. 5 indicating magnetic force would come out of the page towards the viewer in FIG. 6. The magnet that provides the magnetic face 570 can be attached to suitable support members such as 610 and 620 shown in FIG. 6. Two set screws 540 and 630 are shown that go into the hole (similar to 440 shown in FIG. 4) to connect the extension piece 560 to the trigger 530. Of course, other suitable fasteners could be used, including any suitable screw, rivet, etc.

Figure 7:
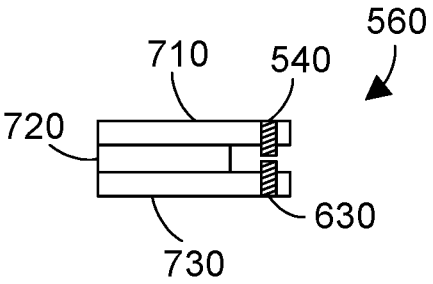
FIG. 7 is a top view of a second implementation for the extension piece shown in FIG. 5.

FIG. 7 shows an alternative configuration for extension piece 560 that includes two side pieces 710 and 730 with a magnet 720 sandwiched between the two. Set screws 540 and 630 can be used to attach the extension piece 560 to trigger 530. While the specific examples in FIGS. 4-7 herein show set screws going into a hole in trigger 530, the set screws could instead provide a clamping force that allow attaching the extension piece 560 onto any suitable location on trigger 530 without passing through a hole.

Figure 8:
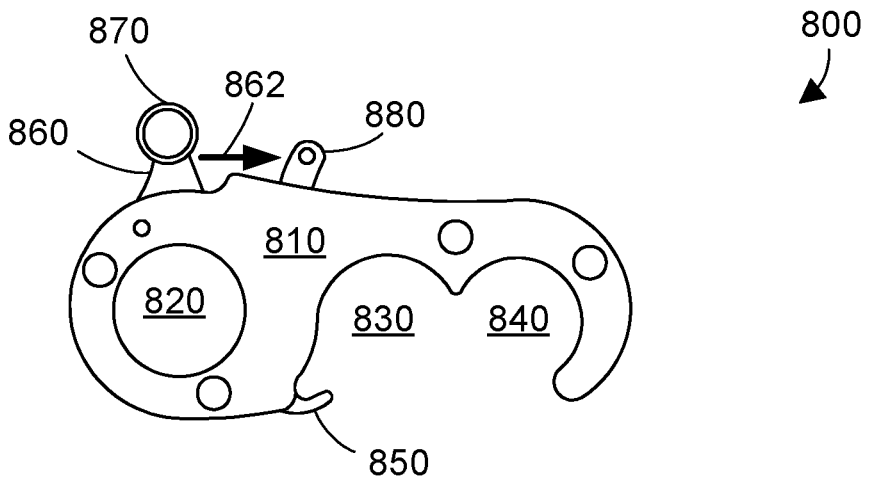
FIG. 8 is a side view of a second suitable trigger release for use in archery.

FIG. 8 shows a second archery release 800 that is very similar to a known archery release. Archery release 800 includes a body portion 810 that defines a finger hole 820 for the shooter's index finger and two recesses 830 and 840 for the shooter's middle and ring fingers, respectively. Release 800 includes a hook 850 for holding a bow string, a trigger 860, and a cocking lever 880. The trigger 860 is actuated by applying a predetermined force to the trigger 860 in the direction of arrow 862 in FIG. 8. The specific configuration in FIG. 8 shows a thumb barrel 870 attached to trigger 860. Release 800 thus is intended to be thumb-actuated by the shooter. The cocking lever 880 cocks the trigger, thereby locking the hook 850 in place in preparation for taking a shot.

To use release 800, a shooter places his or her index finger through hole 820, puts the middle finger in recess 830, and puts the ring finger in recess 840. The shooter then actuates the cocking lever 880, hooks the bow string on hook 850, draws the bow string back, then presses the thumb barrel 870 with his or her thumb in the direction indicated by arrow 862 to apply the predetermined pressure to trigger 830, which actuates an internal mechanical release, which causes the hook 850 to pivot in a clockwise direction, causing the hook 850 to release the bow string, thereby causing the bow to shoot the arrow.

Figure 9:
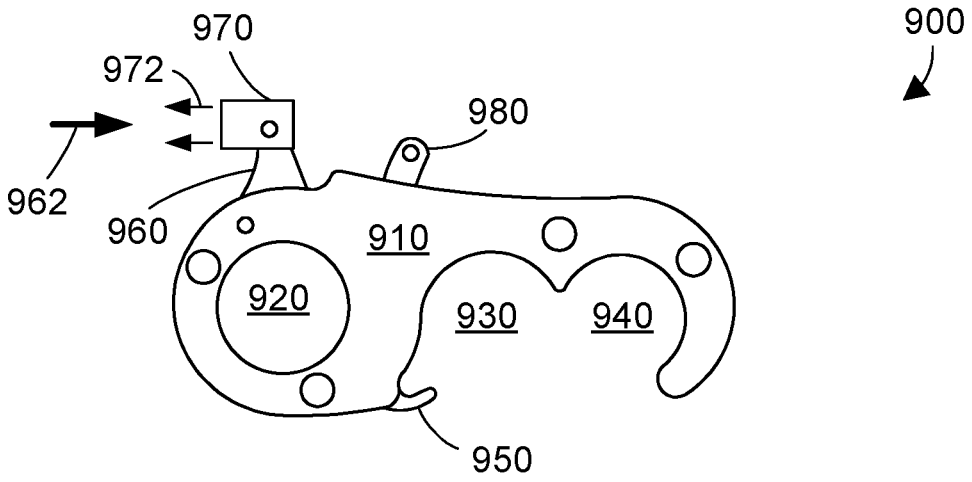
FIG. 9 is a side view of a trigger release similar to the release in FIG. 8 and configured to include a first magnet that can be actuated by magnetic repulsion from a second magnet on a wearable article on the shooter's body.

The release 800 shown in FIG. 8 can be converted to a magnetically-actuated release by removing the thumb barrel 870 in FIG. 8 and replacing it with a magnetic attachment 970 shown in FIG. 9. The body 910, finger slots 920, 930, 940, hook 950, trigger 960 and cocking lever 980 are preferably the same as corresponding items 810, 820, 830, 840, 850. 860 and 880 in FIG. 8, but these could also be different within the scope of the disclosure and claims herein. The magnetic attachment 970 preferably includes a first magnet that provides a magnetic force in the direction indicated by arrows 972 in FIG. 9. When a shooter brings a magnet on a wearable article in proximity to the magnetic attachment 970 in the direction shown by arrow 962 in FIG. 9, the magnet on the wearable article will repel the first magnet in the magnetic attachment 970, thereby creating force on the trigger 960. Once the repulsive force between the magnets reaches the predetermined force needed to actuate the trigger 960, the trigger actuates the internal mechanical release, causing the hook 950 to release the bow string.

In one embodiment, a release similar to release 800 in FIG. 8 can be converted into a magnetically-actuated release by simply removing the thumb barrel 870 and attaching in its place a magnetic attachment 970 shown in FIG. 9. However, in an alternative embodiment, the thumb barrel 870 and/or trigger 860 could be manufactured to include a magnet. Thus, both configurations in FIGS. 8 and 9 represent a trigger release that includes a first magnet that can be magnetically actuated by a second magnet on a wearable article without the first magnet and second magnet touching each other.

Figure 10:
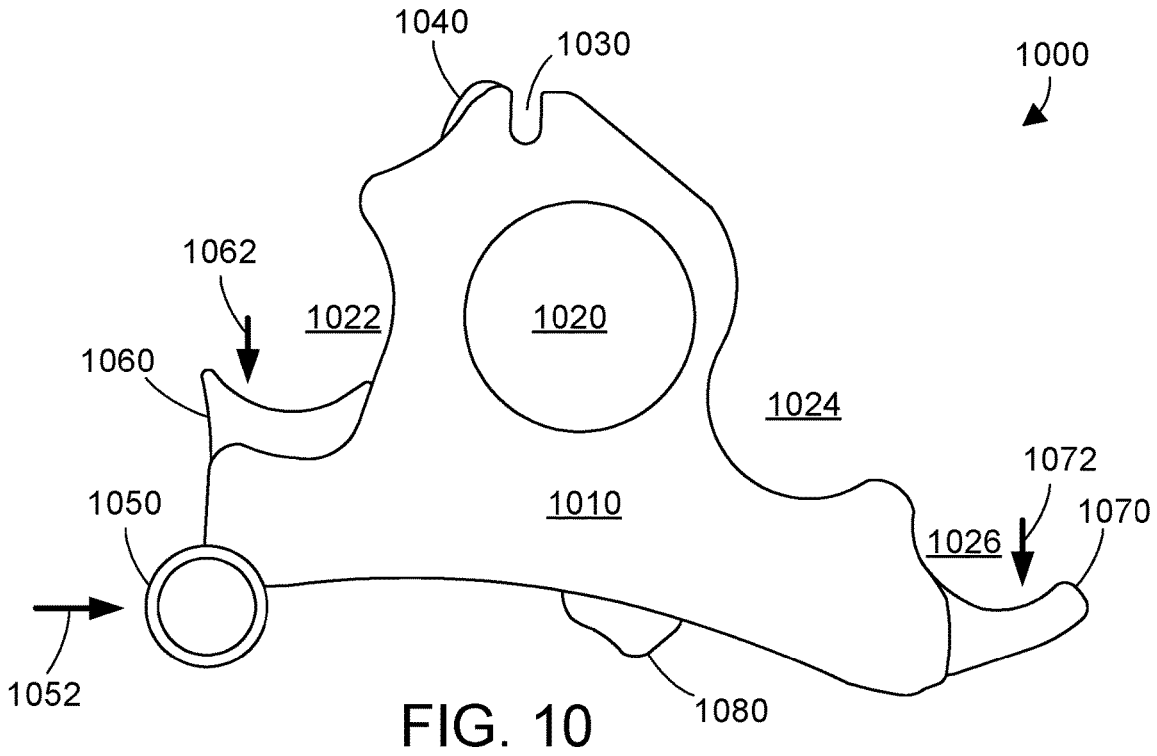
FIG. 10 is a side view of a third suitable trigger release for use in archery.

FIG. 10 shows a third archery release 1000 that is similar in some respects to a known archery release, but is dissimilar in other respects. Archery release 1000 includes a body portion 1010 that defines a finger hole 1020 for the shooter's middle finger and recesses 1022, 1024 and 1026 for the shooter's index finger, ring finger, and pinky, respectively. Release 1000 includes a slot 1030 and a rotating hook 1040 for holding a bow string within slot 1030. Release 1000 includes three different triggers that can be used according to the shooter's preference. A thumb trigger not shown in FIG. 10 has a thumb barrel 1050 that can be pressed in the direction of arrow 1052 in FIG. 10 to apply the predetermined force on the trigger, which actuates an internal mechanical release, which causes the hook 1040 to rotate in a counterclockwise direction, thereby releasing the bow string from the slot 1030. An index finger trigger 1060 can be pressed by the shooter's index finger by pressing in the direction shown by arrow 1062 in FIG. 10. A pinky trigger 1070 can be pressed by the shooter's pinky finger by pressing in the direction shown by arrow 1072 in FIG. 10. These three different triggers provide the shooter with different options that the shooter can use according to the shooter's preference. A cocking lever 1080 cocks the triggers in preparation for taking a shot.

To use release 1000, a shooter places his or her middle finger through hole 1020, puts the index finger in recess 1022, places the ring finger in recess 1024, and places the pinky finger in recess 1026. The shooter then places the bow string within slot 1030 and actuates the hook 1040 to close the slot 1030, then presses the cocking lever 1080 thereby captivating the bow string within the slot 1030. The shooter then draws the bow string back, then activates the release by pressing on one of the thumb barrel 1050, the index finger trigger 1060, or the pinky trigger 1070. All of these three actuate an internal mechanical release, which causes the hook 1040 to pivot in a counterclockwise direction away from slot 1030, thereby releasing the bow string and causing the bow to shoot the arrow.

Figure 11:
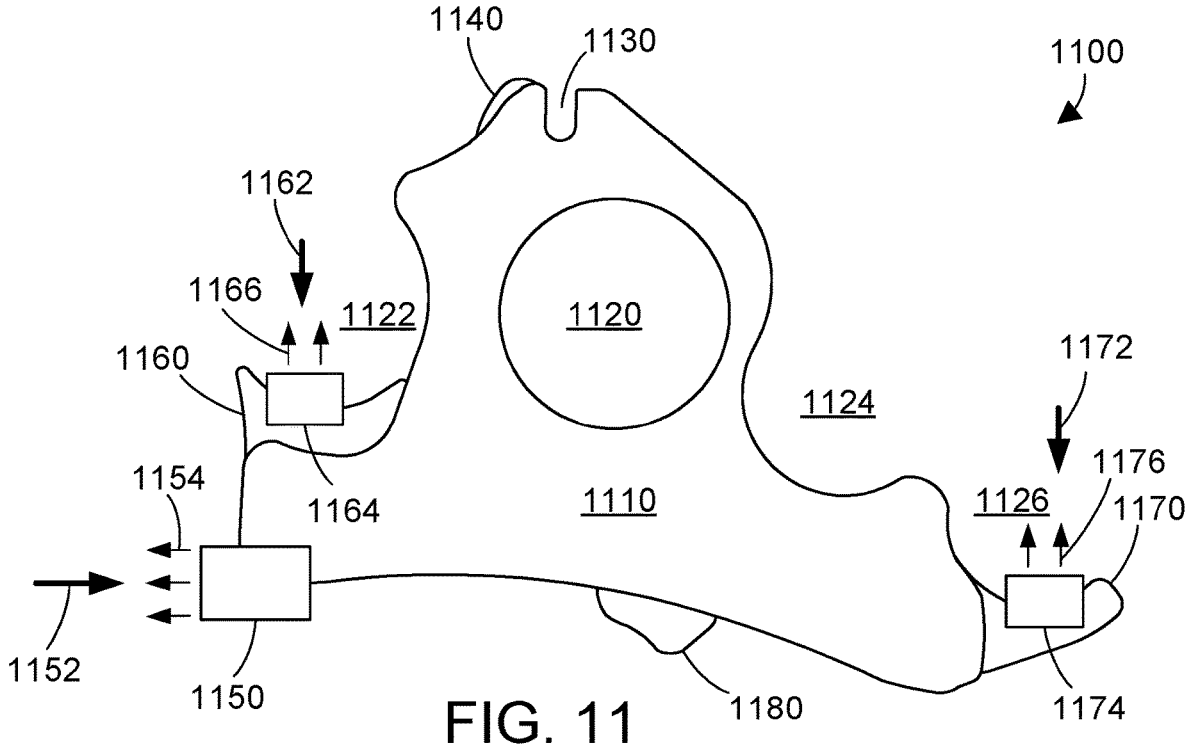
FIG. 11 is a side view of a trigger release similar to the release in FIG. 10 and configured to include a first magnet in one, two or three locations that can be actuated by magnetic repulsion from a second magnet on a wearable article on the shooter's body.

The release 1000 shown in FIG. 10 can be converted to a magnetically-actuated release 1100 shown in FIG. 11 by adding one or more magnetic attachments to one or more of the three triggers. The body 1110, finger slots 1120, 1122, 1124, and 1126, slot 1130 and hook 1140, triggers 1160 and 1170, and cocking lever 1180 are preferably the same as corresponding items 1010, 1020, 1022, 1024, 1026, 1030, 1040, 1060, 1070 and 1080 in FIG. 10, but these could also be different within the scope of the disclosure and claims herein. FIG. 11 shows all three triggers with magnetic attachments, with magnetic attachment 1150 on the thumb trigger, magnetic attachment 1164 on the index finger trigger 1160, and magnetic attachment 1174 on the pinky trigger 1170. Note that all three of these magnetic attachments 1150, 1164 and 1174 need not be present, but the release 1100 could include one, two or all three magnetic attachments within the scope of the disclosure and claims herein. Magnetic attachment 1150 provides a magnetic force indicated by the three arrows 1154 in FIG. 11. Magnetic attachment 1164 provides a magnetic force indicated by the two arrows 1166 in FIG. 11. Magnetic attachment 1174 provides a magnetic force indicated by the two arrows 1176 in FIG. 11. A corresponding magnet on a wearable article will provide a magnetic force in the direction shown by arrow 1152 in FIG. 11 for the thumb trigger. A corresponding magnet on a wearable article will provide a magnetic force in the direction shown by arrow 1162 for the index finger trigger. A corresponding magnet on a wearable article will provide a magnetic force in the direction shown by arrow 1172 for the pinky trigger.

A wearable article, such as a glove, can include magnets that correspond to all three magnetic attachments 1150, 1164 and 1174, thereby giving the shooter three different magnetically-actuated triggers that the shooter can use according to the shooter's preference. In the alternative, the wearable article may contain only one or two magnets corresponding to only one or two of the magnetic attachments 1150, 1164 and 1174. When a shooter brings a magnet on a wearable article in proximity to any of the three magnetic attachments 1150, 1164 and 1174, the magnet on the wearable article will repel the magnet in the corresponding magnetic attachment, thereby creating force on the corresponding trigger. Once the repulsive force between the magnets reaches the predetermined force needed to actuate the corresponding trigger, the trigger actuates the internal mechanical release, causing the hook 1140 pivot away from slot 1130 to release the bow string.

In one embodiment, a release similar to release 1000 in FIG. 10 can be converted into a magnetically-actuated release by adding one or more magnetic attachments 1150, 1164 and 1174 as shown in FIG. 11. However, in an alternative embodiment, one or more of the three triggers could be manufactured to include a magnet. Thus, both configurations in FIGS. 10 and 11 represent a trigger release that includes a first magnet that can be magnetically actuated by a second magnet on a wearable article without the first magnet and second magnet touching each other.

Figure 12:
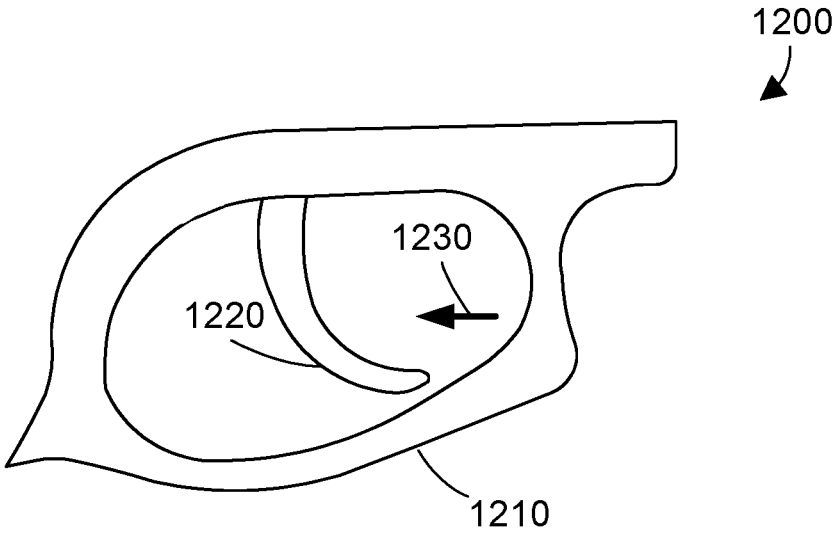
FIG. 12 is a side view of a trigger guard and trigger on a firearm.

Achieving a surprise trigger break is not only beneficial in archery releases, but is also beneficial in firearms as well. One of the most common sources of errant shots from a firearm is due to mashing or jerking the trigger rather than smoothly pressing the trigger until a surprise trigger break occurs. Referring to FIG. 12, a trigger 1220 and trigger guard 1210 of a firearm 1200 are shown. The trigger is actuated by a shooter pressing with a finger (normally the index finger) on the trigger 1220 in the direction shown by arrow 1230 in FIG. 12. Once the trigger has the predetermined force from the shooter's finger, the trigger actuates a mechanical release internal to the firearm, causing the firearm to fire.

Figure 13:
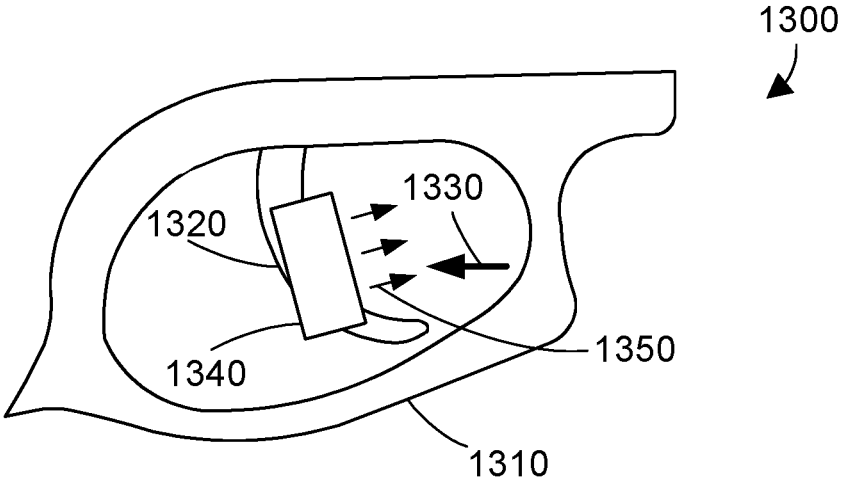
FIG. 13 is a side view of a trigger similar to the trigger in FIG. 12 and configured to include a first magnet that can be actuated by magnetic repulsion from a second magnet on a wearable article in the shooter's body.

Referring to FIG. 13, a trigger 1320 and trigger guard 1310 of a firearm 1300 are shown. The trigger 1310 includes a magnetic attachment 1340 that provides magnetic force in the direction shown by arrows 1350 in FIG. 13. To shoot firearm 1300, a shooter places a finger with a second magnet on a wearable article into the trigger guard 1310 in front of trigger 1320, which creates a repulsive force between the second magnet on the wearable article and the magnetic attachment 1340 on the trigger 1330. As the shooter continues to move the second magnet on his or her finger closer to the magnetic attachment 1340, the repulsive force increases until the predetermined force required for the trigger to actuate is reached. Once this force is reached, the trigger actuates a mechanical release internal to the firearm 1300, causing the firearm 1300 to fire. This happens without the finger of the shooter or the magnet in the wearable article ever contacting the trigger 1320 or magnetic attachment 1340.

Figure 14:
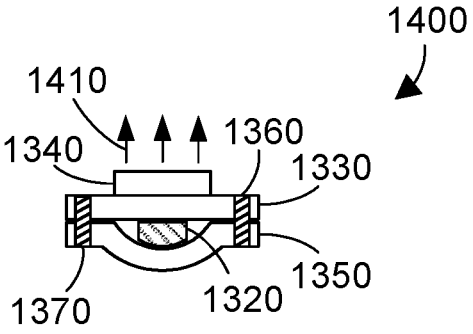
FIG. 14 is a top view of a suitable trigger clamp that includes a first magnet.

One suitable example for magnetic attachment 1340 in FIG. 13 is shown as 1400 in FIG. 14. Magnetic attachment 1400 includes a front clamp portion 1330 and a rear clamp portion 1350 that are placed around a trigger 1320. The front clamp portion 1330 includes a magnet 1340 that provides a magnetic force in the direction shown by arrows 1410 in FIG. 14. The front clamp portion 1330 is attached to the rear clamp portion 1350 to attach the magnetic attachment 1400 to trigger 1320 using one or more suitable fasteners. In FIG. 14, the front clamp portion 1330 is attached to the rear clamp portion 1350 using two set screws 1360 and 1370 while captivating trigger 1320. Of course, other means of attaching the magnetic attachment 1400 to trigger 1320 are also within the scope of the disclosure and claims herein.

In one embodiment, a firearm trigger similar to trigger 1220 in FIG. 12 can be converted into a magnetically-actuated release by adding the magnetic attachment 1340 as shown in FIG. 13. However, in an alternative embodiment, the trigger 1220 could be manufactured to include a magnet. Thus, both configurations in FIGS. 12 and 13 represent a trigger release that includes a first magnet that can be magnetically actuated by a second magnet on a wearable article without the first magnet and second magnet touching each other.

Figure 15:
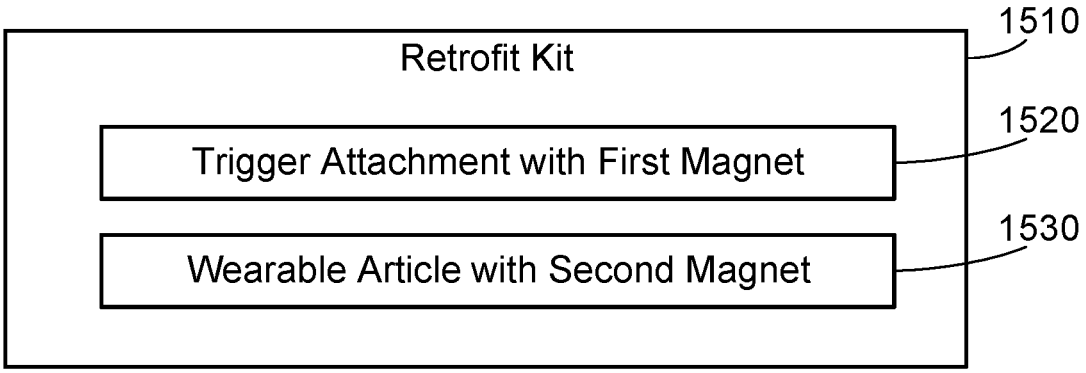
FIG. 15 is a block diagram of a retrofit kit in accordance with the first and second embodiments.

The four different embodiments in FIGS. 4, 5 and 8-13 discussed above allow retrofitting a trigger release with a magnetic attachment. The preferred embodiments thus include a retrofit kit to convert a trigger release that normally requires a shooter to press a trigger to instead use a magnetically-actuated release as disclosed herein. Referring to FIG. 15, a retrofit kit 1510 within the scope of the disclosure and claims herein includes a trigger attachment with a first magnet 1520, and a wearable article with a second magnet 1530 that is oriented to provide a magnetic force when brought into proximity of the first magnet on the trigger attachment.

Figure 16:
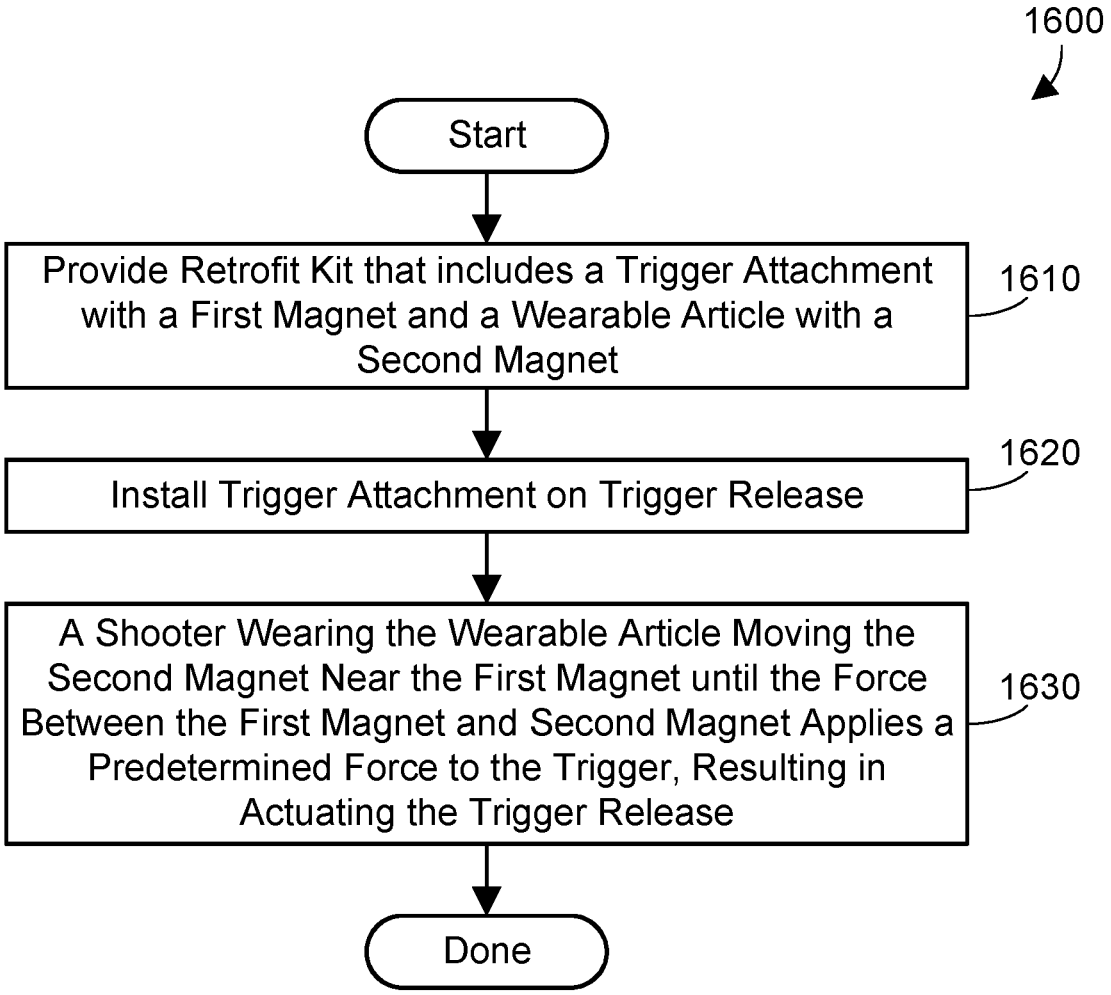
FIG. 16 is a flow diagram of a method in accordance with the first and second embodiments.

Referring to FIG. 16, a method 1600 for retrofitting an existing trigger release that is not magnetically-actuated to be magnetically-actuated includes providing the retrofit kit 1510 shown in FIG. 15 (step 1610), installing the trigger attachment on the trigger release (step 1620), and a shooter wearing the wearable article moving the second magnet near the first magnet until the force between the first magnet and second magnet applies a predetermined force to the trigger, resulting in actuating the trigger release (step 1630). Method 1600 is then done.

Field tests by the inventor have shown that using trigger releases that function on magnetic repulsion improves accuracy of shots. Known releases that require a shooter to press a trigger with a finger or thumb can result in the shooter anticipating the break of the trigger, resulting in the shooter's finger mashing or punching the trigger. With the magnetic repulsion trigger release system of the first embodiment disclosed herein, it is much more difficult for the shooter to mash the trigger because the shooter's focus is on getting the alignment between the magnet on the wearable article aligned with the magnet on the trigger. If the shooter tries to hurry the shot, the magnetic repulsion can divert the pressure to the side of the first magnet and the magnetic trigger release will not actuate. To actuate the magnetic trigger release, the shooter must focus on keeping the second magnet aligned with the first magnet while slowly moving the second magnet closer to the first magnet until a surprise trigger break occurs. The result is substantially improved accuracy using the magnetic repulsion trigger release system of the first embodiment.

Figure 17:
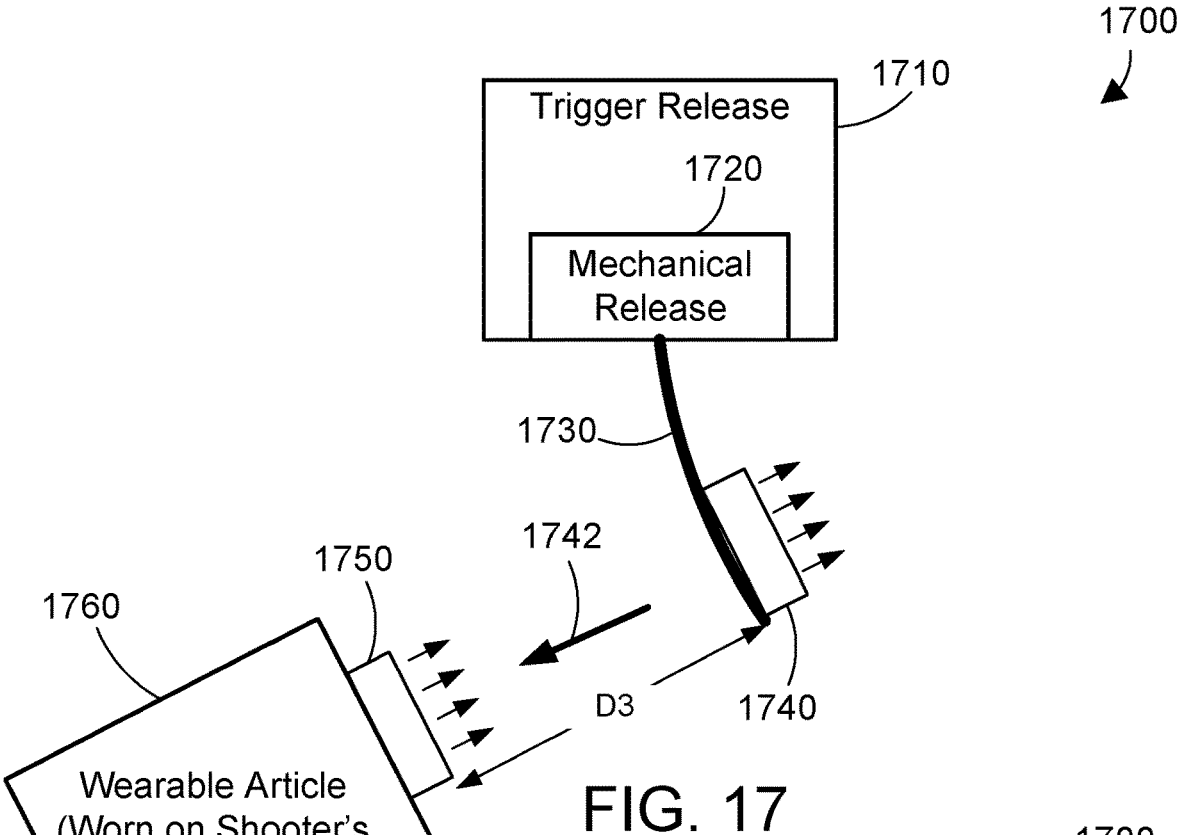
FIG. 17 is a block diagram of a magnetic trigger release system in accordance with a second embodiment showing a second magnet in the wearable article at a first distance from the first magnet on the trigger.

A second embodiment of the trigger release system disclosed herein uses magnetic attraction instead of magnetic repulsion. Referring to FIG. 17, a trigger release system 1700 in accordance with the second embodiment operates based on magnetic attraction. The trigger release system 1700 includes a trigger release 1710 that has a trigger 1730 that actuates a mechanical release 1720, thereby causing actuation of the trigger release. The trigger 1730 has a first magnet 1740 attached to the trigger. The first magnet 1740 can be manufactured to be an integral part of trigger 1730, or can be an aftermarket add-on that is attached to trigger 1730 in any suitable way. The trigger release system 1700 includes not only the trigger release 1710, but also includes a wearable article 1760 that is worn on a shooter's body. The wearable article 1760 includes a second magnet 1750 that is oriented such that the second magnet 1750 provides an attractive force when brought into proximity to the first magnet 1740. It is well-known that opposite poles of two magnets attract while the same poles of the two magnets repel. Thus, if the first magnet is 1740 is oriented with its south pole against the trigger and its north pole facing the direction of the four arrows in FIG. 17 emanating from the first magnet 1740, this means the second magnet 1750 is oriented with its south pole closer to the shooter's body and its north pole facing the direction of the four arrows in FIG. 17 emanating from the second magnet 1750. Similarly, if the first magnet is 1740 is oriented with its north pole against the trigger and its south pole facing the direction of the four arrows in FIG. 17 emanating from the first magnet 1740, this means the second magnet 1750 is oriented with its north pole closer to the shooter's body and its south pole facing the direction of the four arrows in FIG. 17 emanating from the second magnet 1750. In both cases, the first magnet 1740 and second magnet 1750 are oriented to attract each other.

The trigger 1730 on trigger release 1710 is configured to actuate the mechanical release 1720 once a predetermined force is applied to the face of the trigger 1730. In FIG. 17, the force applied to the trigger 1730 is in the direction shown by arrow 1742. Once the predetermined force is applied to trigger 1730 in the direction of the arrow 1742, the trigger actuates the mechanical release 1720, which causes the trigger release to be actuated.

Figure 18:
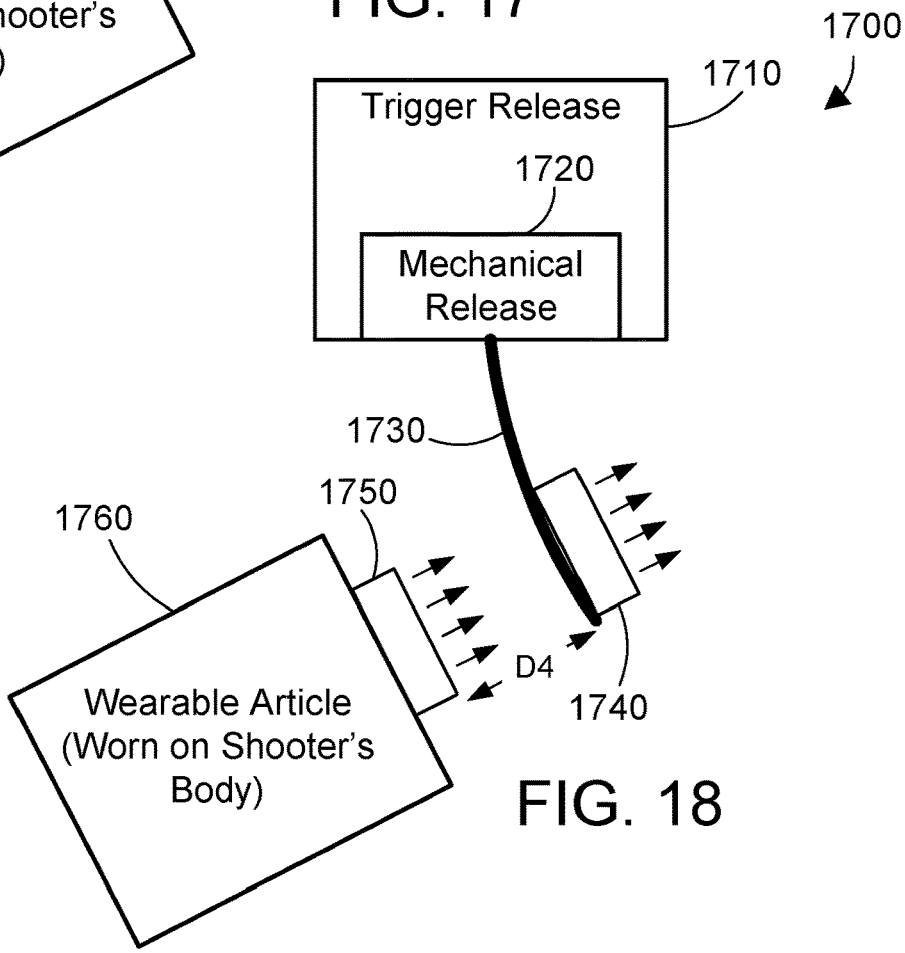
FIG. 18 is a block diagram of the magnetic trigger release system in FIG. 17 showing the second magnet in the wearable article at a second distance from the first magnet on the trigger which increases the force on the trigger due to magnetic attraction.

In FIG. 17 the second magnet 1750 is at a first distance D3 from first magnet 1740. FIG. 18 shows the same components in FIG. 17 with the second magnet 1750 at a closer distance D4 from the first magnet 1740. We assume for this simple example that distance D3 in FIG. 17 between the second magnet 1750 and the first magnet 1740 causes little to no attractive force between the magnets, while distance D4 in FIG. 18 causes significant attractive force between the magnets, which creates force on trigger 1730. As the distance between magnets 1740 and 1750 decreases by the shooter moving the second magnet 1750 on the wearable article 1760 closer to the first magnet 1740, the force on trigger 1730 increases until a point is reached where the predetermined force on the trigger is applied by magnetic attraction, causing the trigger 1730 to actuate the mechanical release 1720 without the two magnets 1740 and 1750 ever touching. The result is a surprise break for trigger release 1710, which greatly increases accuracy of the shooter.

The magnets 1740 and 1750 can have any suitable size, strength and configuration and can be of any suitable type to perform their intended function. The only constraint on the magnets 1740 and 1750 is they must be strong enough to cause an attractive force greater than the predetermined force that causes the trigger 1730 to actuate the mechanical release 1720. All magnets that provide an attractive force that exceeds the predetermined force that causes the trigger 1730 to actuate the mechanical release 1720 are within the scope of the disclosure and claims herein.

Figure 19:
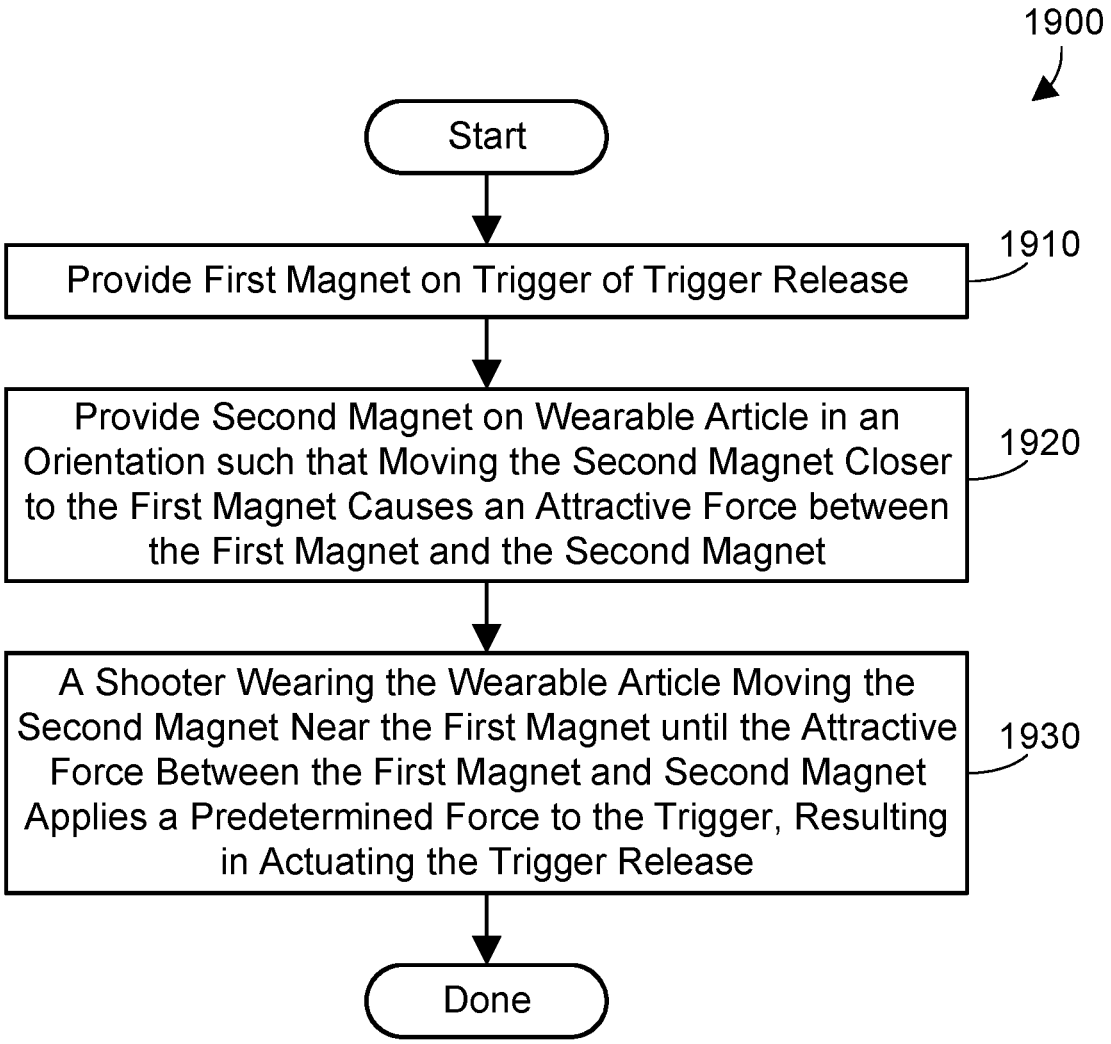
FIG. 19 is a flow diagram of a method in accordance with the second embodiment.

Referring to FIG. 19, a method 1900 in accordance with the second embodiment provides a first magnet on a trigger of a trigger release (step 1910). A second magnet is provided on a wearable article in an orientation such that moving the second magnet closer to the first magnet causes an attractive force between the first magnet and the second magnet (step 1920). A shooter wearing the wearable article then moves the second magnet near the first magnet until the attractive force between the first magnet and second magnet applies a predetermined force to the trigger, resulting in actuating the trigger release (step 1930). Method 1900 is then done.

The second embodiment encompasses the same retrofit kit 1510 in FIG. 15 and the same method 1600 in FIG. 16. The difference between the first embodiment and the second embodiment is the relative orientation of the first and second magnets. In the first embodiment, the second magnet on the wearable article is oriented to provide a repulsive force with respect to the first magnet. In the second embodiment, the second magnet on the wearable article is oriented to provide an attractive force with respect to the first magnet.

Figure 20:
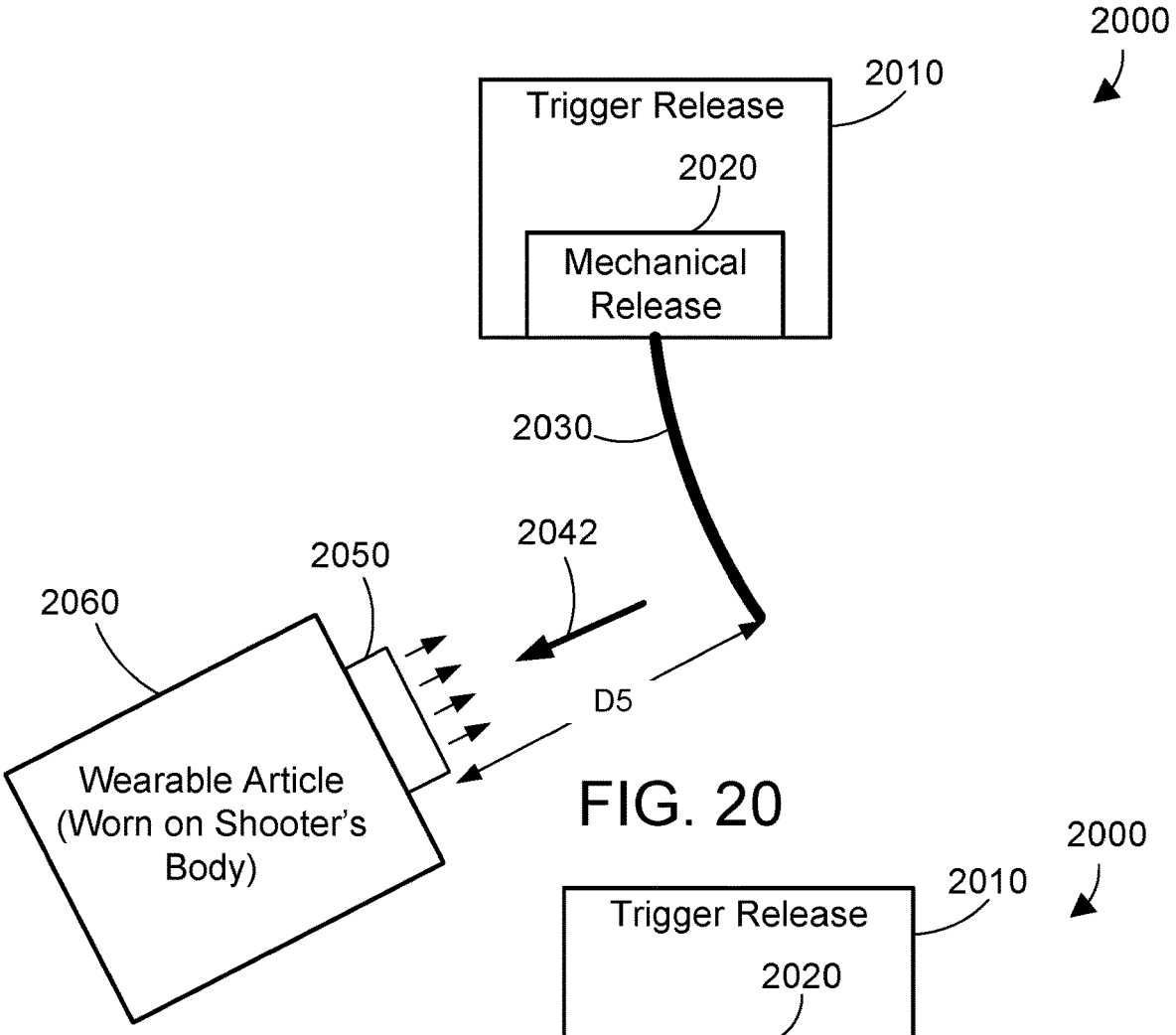
FIG. 20 is a block diagram of a magnetic trigger release system in accordance with a third embodiment showing a magnet in the wearable article at a first distance from a trigger made of a magnetic metal.

A third embodiment of the trigger release system disclosed herein uses magnetic attraction, but instead of using magnetic attraction between two magnets as disclosed above for the second embodiment, the third embodiment uses magnetic attraction between one magnet on the wearable article and a trigger that is made of magnetic metal, meaning a metal that is attracted to magnets. Referring to FIG. 20, a trigger release system 2000 in accordance with the third embodiment operates based on magnetic attraction. The trigger release system 2000 includes a trigger release 2010 that has a trigger 2030 that actuates a mechanical release 2020, thereby causing actuation of the trigger release. The trigger 2030 is made of a magnetic metal, meaning a metal that is attracted to magnets. The trigger release system 2000 includes not only the trigger release 2010, but also includes a wearable article 2060 that is worn on a shooter's body. The wearable article 2060 includes a magnet 2050 that is oriented such that the magnet 2050 provides an attractive force on the trigger 2030 when brought into proximity to the trigger 2030.

The trigger 2030 on trigger release 2010 is configured to actuate the mechanical release 2020 once a predetermined force is applied to the face of the trigger 2030. In FIG. 20, the force applied to the trigger 2030 is in the direction shown by arrow 2042. Once the predetermined force is applied to trigger 2030 in the direction of the arrow 2042, the trigger actuates the mechanical release 2020, which causes the trigger release to be actuated.

Figure 21:
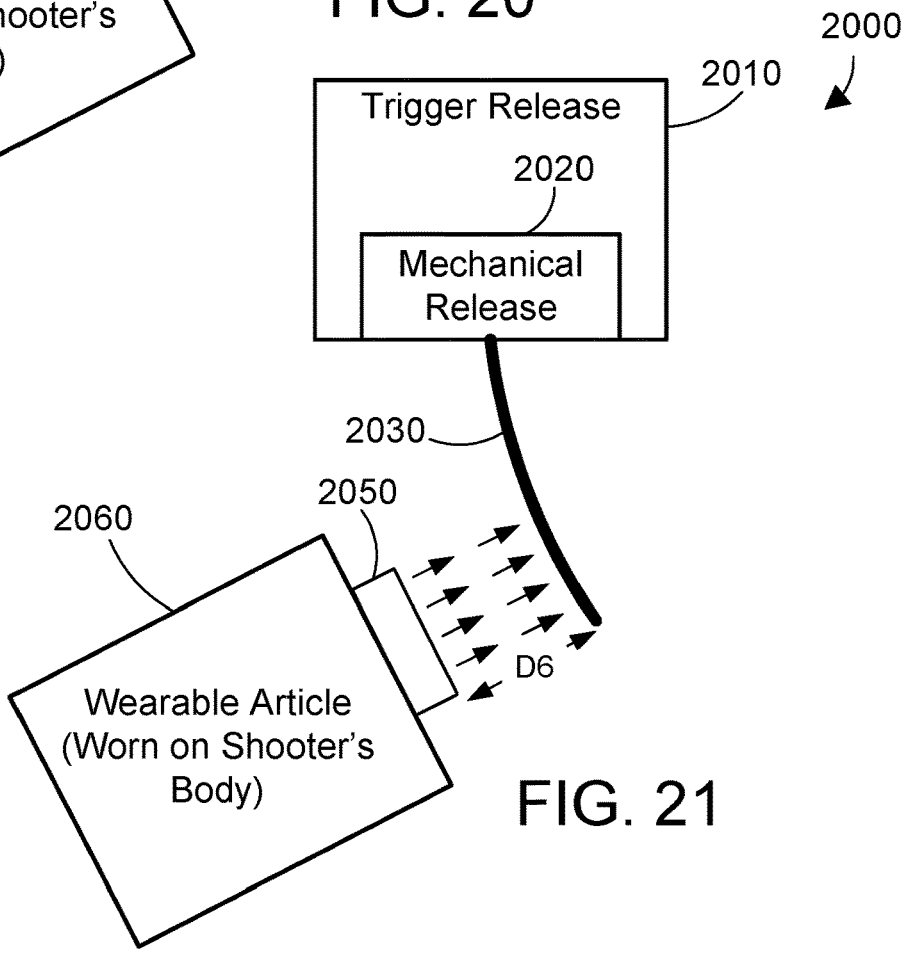
FIG. 21 is a block diagram of the magnetic trigger release system in FIG. 20 showing the magnet in the wearable article at a second distance from the trigger which increases the force on the trigger due to magnetic attraction.

In FIG. 20 the magnet 2050 is at a first distance D5 from trigger 2030. FIG. 21 shows the same components in FIG. 20 with the magnet 2050 at a closer distance D6 from the trigger 2030. We assume for this simple example that distance D5 in FIG. 20 between the magnet 2050 and the trigger 2030 causes little to no attractive force between the magnet 2050 and the trigger 2030, while distance D6 in FIG. 21 causes significant attractive force between the magnet 2050 and the trigger 2030, which creates force on trigger 2030. As the distance between the magnet 2050 and the trigger 2030 decreases by the shooter moving the magnet 2050 on the wearable article 2060 closer to the trigger 2030, the force on trigger 2030 increases until a point is reached where the predetermined force on the trigger is applied by magnetic attraction, causing the trigger 2030 to actuate the mechanical release 2020 without the magnets 2050 ever touching the trigger 2030. The result is a surprise break for trigger release 2010, which greatly increases accuracy of the shooter.

The magnet 2050 and trigger 2030 can have any suitable size, strength and configuration to perform their intended function. The only constraint on the magnet 2050 is it must be strong enough to cause an attractive force greater than the predetermined force that causes the trigger 2030 to actuate the mechanical release 2020 without touching the magnet 2050 to the trigger 2030. All magnets that provide an attractive force that exceeds the predetermined force that causes the trigger 2030 to actuate the mechanical release 2020 are within the scope of the disclosure and claims herein.

Figure 22:
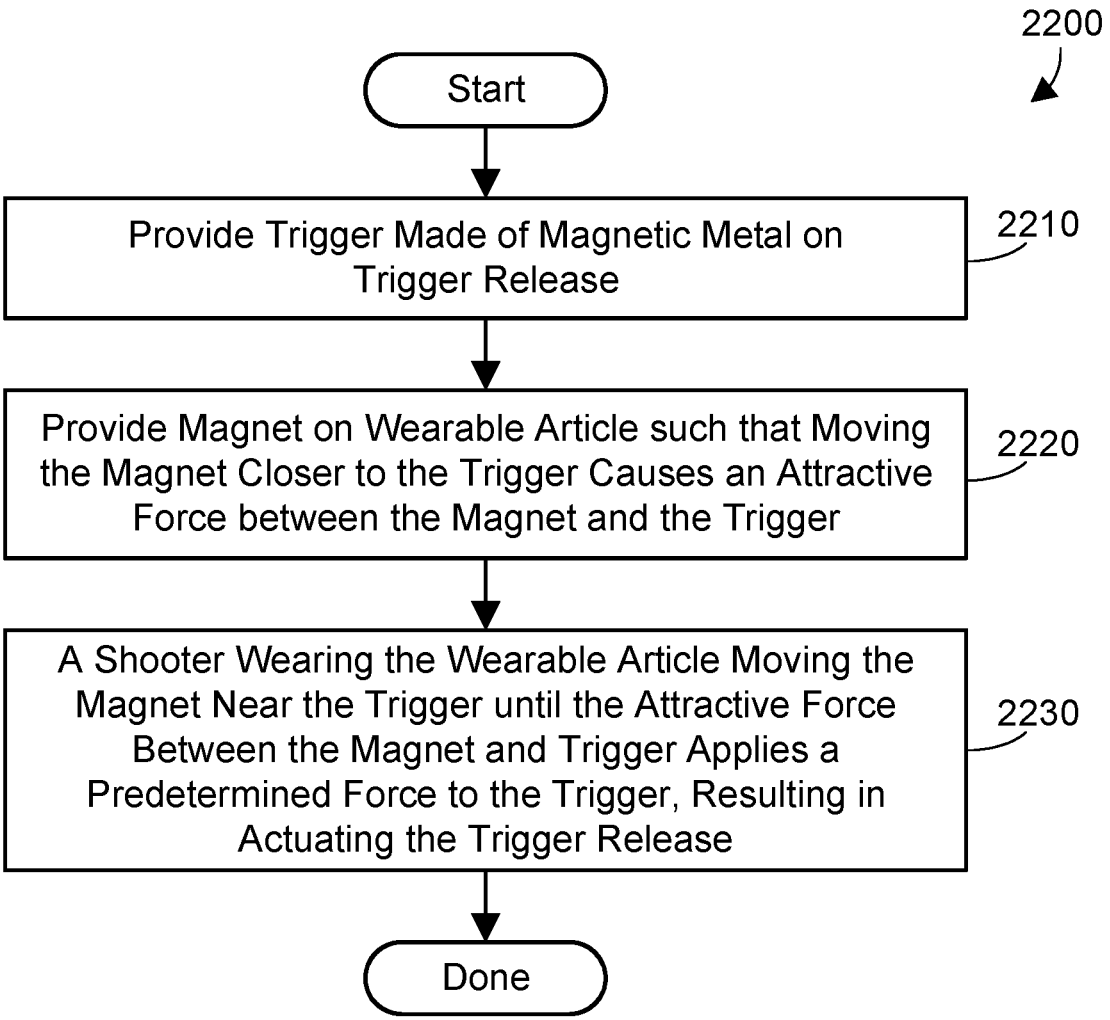
FIG. 22 is a flow diagram of a method in accordance with the third embodiment.

Referring to FIG. 22, a method 2200 in accordance with the third embodiment provides a trigger made of magnetic metal on the trigger release (step 2210). Magnetic metal as used herein means metal that is attracted to magnets. A magnet is provided on a wearable article in an orientation such that moving the magnet closer to the trigger causes an attractive force between the magnet and the trigger (step 2220). A shooter wearing the wearable article then moves the magnet near the trigger until the attractive force between the magnet and trigger applies a predetermined force to the trigger, resulting in actuating the trigger release (step 2230). Method 2200 is then done.

Figure 23:
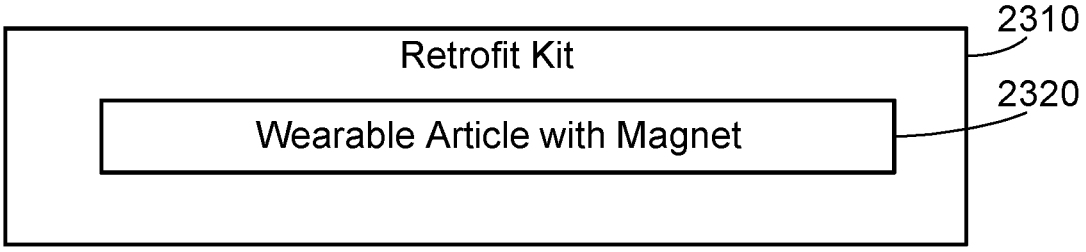
FIG. 23 is a block diagram of a retrofit kit in accordance with the third embodiment.
Figure 24:
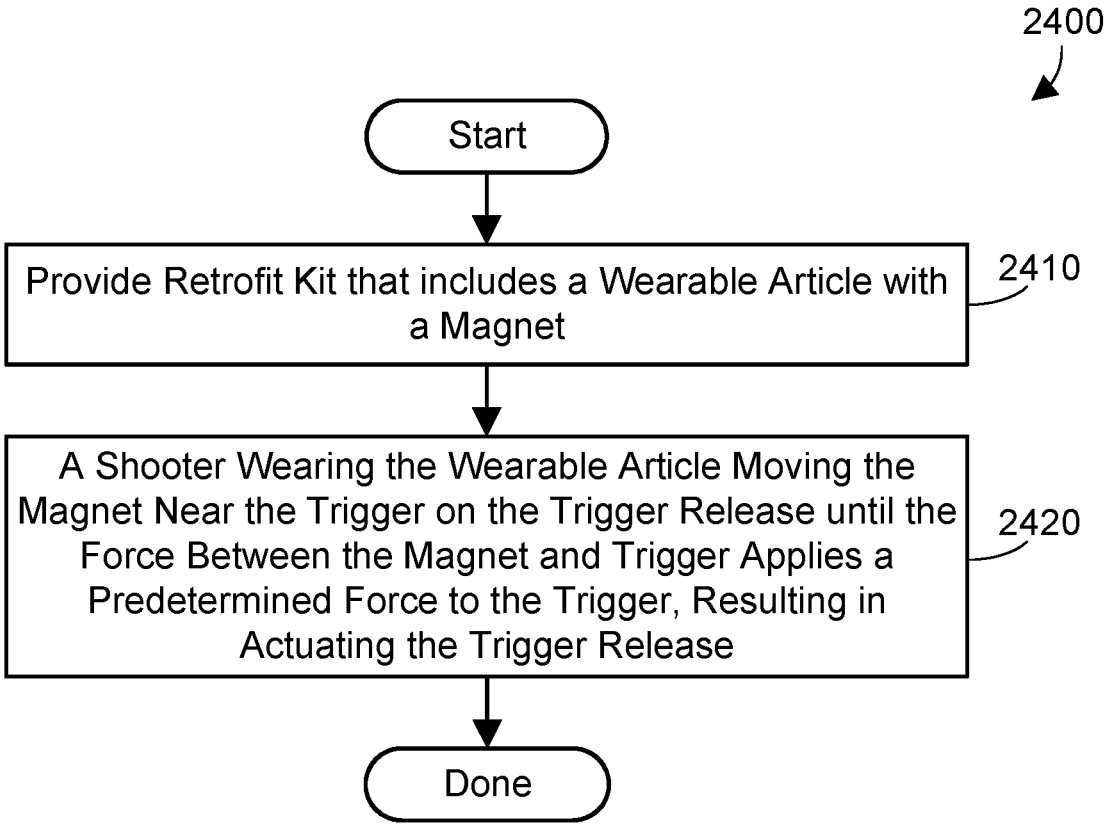
FIG. 24 is a flow diagram of a method in accordance with the third embodiment.

The third embodiment uses a different retrofit kit than the first and second embodiments because the third embodiment has a single magnet instead of two magnets. Referring to FIG. 23, the retrofit kit 2310 for the third embodiment includes a wearable article with a magnet 2320. Referring to FIG. 24, a method 2400 in accordance with the third embodiment starts by providing the retrofit kit 2310 in FIG. 23 (step 2410). A shooter wearing the wearable article then moves the magnet near the trigger on the trigger release until the force between the magnet and the trigger applies a predetermined force to the trigger, resulting in actuating the trigger release (step 2420). Method 2400 is then done. The third embodiment and method 2400 assume the trigger on the trigger release is made of magnetic metal that is attracted to the magnet on the wearable article.

While the specific releases shown in FIGS. 4, 5 and 8-13 are discussed above with respect to the first embodiment that uses magnetic repulsion, each of these releases could also be configured to use magnetic attraction as disclosed in the second and third embodiments. Furthermore, while the releases disclosed herein all have external triggers that can be magnetically actuated, the disclosure and claims herein expressly extend to any suitable trigger mechanism, including internal triggers, that can be magnetically actuated using either magnetic repulsion or magnetic attraction.

A trigger release system includes a trigger release that is magnetically-actuated. The trigger on the trigger release is coupled to a mechanical release such that a predetermined amount of force on the trigger causes the mechanical release to trip. A first embodiment uses magnetic repulsion between a magnet on a wearable article worn by the shooter and a magnet on the trigger. A second embodiment uses magnetic attraction between a magnet on a wearable article worn by the shooter and a magnet on the trigger. A third embodiment uses magnetic attraction between a magnet on a wearable article and a trigger made of magnetic metal. All three embodiments provide a magnetically-actuated trigger release.

In the first and second embodiments, the shooter activates the trigger release by closing the gap between the two magnets by moving the magnet on the shooter's body to be closer to the magnet on the trigger portion. In the first embodiment, the magnet on the wearable article on the shooter's body is oriented to provide a repulsive force to a magnet on the trigger such that the shooter moving the magnet worn on the shooter's body closer to the magnet on the trigger causes the repulsive force between the magnets to increase until the repulsive force provides the predetermined amounted of force on the trigger, thereby causing the trigger to actuate the mechanical release. In a second embodiment, the magnet on the wearable article on the shooter's body is oriented to provide an attractive force to a magnet on the trigger such that the shooter moving the magnet worn on the shooter's body closer to the magnet on the trigger causes the attractive force between the magnets to increase until the attractive force provides the predetermined amount of force on the trigger, thereby causing the trigger to actuate the mechanical release. In a third embodiment, the trigger of the trigger release is made of a magnetic metal such that the shooter moving a magnet worn on the wearable article on the shooter's body closer to the trigger causes the attractive force between the magnet and the trigger to increase until the attractive force provides the predetermined amount of force on the trigger, thereby causing the trigger to actuate the mechanical release. Providing a trigger release system with a magnetically-actuated trigger release provides a surprise actuation of the trigger release, thereby improving accuracy of the shooter.

The disclosure and claims herein support a trigger release system comprising: a trigger release comprising a trigger coupled to a mechanical release, wherein the trigger actuates the mechanical release when a predetermined force is applied to the trigger, the trigger release further comprising a first magnet coupled to the trigger; and a wearable article worn on a shooter's body, wherein the wearable article comprises a second magnet in an orientation that provides a magnetic force such that the shooter moving the second magnet to be closer to the first magnet increases the magnetic force applied to the trigger until the magnetic force provides the predetermined force to the trigger, thereby actuating the mechanical release without the second magnet touching the first magnet.

The disclosure and claims herein further support an archery trigger release system comprising: an archery trigger release comprising a trigger coupled to a mechanical release, wherein the trigger actuates the mechanical release when a predetermined force is applied to the trigger, wherein actuation of the mechanical release causes release of a bow string held by the mechanical release, wherein the archery trigger release further comprises a first magnet coupled to the trigger; and a wearable article worn on a shooter's body that comprises a second magnet such that the shooter moving the second magnet to be closer to the first magnet increases a force applied to the trigger until the force provides the predetermined force to the trigger, thereby actuating the mechanical release without the second magnet touching the first magnet, wherein actuation of the mechanical release causes the bow string to be released.

The disclosure and claims herein additionally support a retrofit kit for retrofitting a trigger release comprising a trigger coupled to a mechanical release, wherein the trigger actuates the mechanical release when a predetermined force is applied to the trigger, the retrofit kit comprising: a trigger attachment with a first magnet, wherein the trigger attachment is configured to be attached to the trigger of the trigger release; and a wearable article with a second magnet oriented to provide a force when the second magnet is brought in proximity to the first magnet in the trigger attachment such that a shooter moving the second magnet to be closer to the first magnet increases the force applied to the trigger until the force provides the predetermined force to the trigger, thereby actuating the mechanical release without the second magnet touching the first magnet.

The disclosure and claims herein still further support a method for using magnetism to actuate a trigger release that comprises a trigger that actuates the trigger release when a predetermined force is applied to the trigger, the method comprising: providing a first magnet on the trigger of the trigger release; providing a second magnet on a wearable article in an orientation such that moving the second magnet closer to the first magnet causes a magnetic force between the first magnet and the second magnet; and a shooter wearing the wearable article moving the second magnet near the first magnet until the magnetic force between the first magnet and the second magnet applies the predetermined force to the trigger, resulting in actuating the trigger release.

One skilled in the art will appreciate that many variations are possible within the scope of the claims. Thus, while the disclosure is particularly shown and described above, it will be understood by those skilled in the art that these and other changes in form and details may be made therein without departing from the spirit and scope of the claims.

The invention claimed is:

1. A trigger release system comprising:

a trigger release comprising a trigger coupled to a mechanical release, wherein the trigger actuates the mechanical release when a predetermined force is applied to the trigger, the trigger release further comprising a first magnet coupled to the trigger; and a wearable article worn on a shooter's body, wherein the wearable article comprises a second magnet in an orientation that provides a magnetic force such that the shooter moving the second magnet to be closer to the first magnet increases the magnetic force applied to the trigger until the magnetic force provides the predetermined force to the trigger, thereby actuating the mechanical release without the second magnet touching the first magnet.

2. The trigger release system of claim 1 wherein the second magnet is oriented with respect to the first magnet to provide magnetic repulsion between the first magnet and the second magnet.

3. The trigger release system of claim 1 wherein the second magnet is oriented with respect to the first magnet to provide magnetic attraction between the first magnet and the second magnet.

4. The trigger release system of claim 1 wherein the trigger release is an archery release.

5. The trigger release system of claim 1 wherein the trigger release is a firearm release.

6. The trigger release system of claim 1 wherein first magnet is attached to the trigger.

7. The trigger release system of claim 1 wherein the first magnet is formed as part of the trigger.

8. The trigger release system of claim 1 wherein the wearable article comprises a glove that includes the second magnet.

9. The trigger release system of claim 1 wherein the wearable article comprises a strap that can be attached to the body of the shooter, wherein the strap includes the second magnet.

10. The trigger release system of claim 1 wherein the wearable article comprises a ring that can be worn on a finger or thumb of the shooter, wherein the ring includes the second magnet.

11. The trigger release system of claim 1 wherein the wearable article comprises tape attached to the second magnet that can be attached to the body of the shooter.

12. An archery trigger release system comprising:

an archery trigger release comprising a trigger coupled to a mechanical release, wherein the trigger actuates the mechanical release when a predetermined force is applied to the trigger, wherein actuation of the mechanical release causes release of a bow string held by the mechanical release, wherein the archery trigger release further comprises a first magnet coupled to the trigger; and a wearable article worn on a shooter's body that comprises a second magnet such that the shooter moving the second magnet to be closer to the first magnet increases a force applied to the trigger until the force provides the predetermined force to the trigger, thereby actuating the mechanical release without the second magnet touching the first magnet, wherein actuation of the mechanical release causes the bow string to be released.

13. The archery trigger release system of claim 12 wherein the second magnet is oriented with respect to the first magnet to provide magnetic repulsion between the first magnet and the second magnet.

14. The archery trigger release system of claim 12 wherein the second magnet is oriented with respect to the first magnet to provide magnetic attraction between the first magnet and the second magnet.

15. The archery trigger release system of claim 12 wherein first magnet is attached to the trigger.

16. The archery trigger release system of claim 12 wherein the first magnet is formed as part of the trigger.

17. The archery trigger release system of claim 12 wherein the wearable article comprises a glove.

18. The archery trigger release system of claim 12 wherein the wearable article comprises a strap that can be attached to the body of the shooter.

19. The archery trigger release system of claim 12 wherein the wearable article comprises a ring that can be worn on the body of the shooter.

20. A retrofit kit for retrofitting a trigger release comprising a trigger coupled to a mechanical release, wherein the trigger actuates the mechanical release when a predetermined force is applied to the trigger, the retrofit kit comprising:

a trigger attachment with a first magnet, wherein the trigger attachment is configured to be attached to the trigger of the trigger release; and a wearable article with a second magnet oriented to provide a force when the second magnet is brought in proximity to the first magnet in the trigger attachment such that a shooter moving the second magnet to be closer to the first magnet increases the force applied to the trigger until the force provides the predetermined force to the trigger, thereby actuating the mechanical release without the second magnet touching the first magnet.

21. A method for using magnetism to actuate a trigger release that comprises a trigger that actuates the trigger release when a predetermined force is applied to the trigger, the method comprising:

providing a first magnet on the trigger of the trigger release;

providing a second magnet on a wearable article in an orientation such that moving the second magnet closer to the first magnet causes a magnetic force between the first magnet and the second magnet; and a shooter wearing the wearable article moving the second magnet near the first magnet until the magnetic force between the first magnet and the second magnet applies the predetermined force to the trigger, resulting in actuating the trigger release.

* * * * *